US005472057A

United States Patent [19]

Winfree

[11] Patent Number: 5,472,057

[45] Date of Patent: Dec. 5, 1995

[54] DRILLING WITH CASING AND RETRIEVABLE BIT-MOTOR ASSEMBLY

[75] Inventor: Michael B. Winfree, Anchorage, Ak.

[73] Assignee: Atlantic Richfield Company, Los Angeles, Calif.

[21] Appl. No.: 387,959

[22] Filed: Feb. 9, 1995

Related U.S. Application Data

[63] Continuation of Ser. No. 226,202, Apr. 11, 1994.

[51] Int. Cl.[6] ..... E21B 7/00

[52] U.S. Cl. ..... 175/57; 175/101; 175/107; 175/171; 175/259; 175/267

[58] Field of Search ..... 175/57, 101, 107, 175/171, 202, 203, 259, 267, 269, 278, 289

[56] References Cited

U.S. PATENT DOCUMENTS

| | | | |
|---|---|---|---|
| 3,661,218 | 5/1972 | Brown | 173/107 |
| 4,133,396 | 1/1979 | Tschirky | 175/57 |
| 4,544,041 | 10/1985 | Rinaldi | 175/57 |
| 4,646,856 | 3/1987 | Dismukes | 175/107 |
| 4,759,413 | 7/1988 | Bailey et al. | 175/171 X |
| 5,060,736 | 10/1991 | Neff | 175/267 X |
| 5,168,942 | 12/1992 | Wydrinski | 175/107 |
| 5,186,265 | 2/1993 | Henson et al. | 175/107 |
| 5,197,553 | 3/1993 | Leturno | 175/57 |
| 5,271,472 | 12/1993 | Leturno | 175/107 |
| 5,307,886 | 5/1994 | Hopper | 175/57 X |
| 5,361,859 | 11/1994 | Tibbitts | 175/286 |

*Primary Examiner*—Roger J. Schoeppel
*Attorney, Agent, or Firm*—Michael E. Martin

[57] ABSTRACT

A wellbore is formed in the earth with an elongated, non-rotating tubular drillstem which may consist of a well casing or liner and including an expendable sub and reamer bit part connected to the lower distal end of the drillstem. A retrievable drilling fluid operated motor and drive member assembly are disposed in the drillstem. The motor and drive member include pressure fluid responsive mechanism for engagement with and disengagement from the reamer bit part to rotatably drive the reamer bit part and a central bit part connected to the drive member without rotating the casing type drillstem. The motor, drive member and central bit part may be retracted from the drillstem upon completion of drilling operations without retrieving the expendable reamer bit part.

8 Claims, 2 Drawing Sheets

DRILLING WITH CASING AND RETRIEVABLE BIT-MOTOR ASSEMBLY

This application is a continuation, of application Ser. No. 08/226,202 filed Apr. 11, 1994.

BACKGROUND OF THE INVENTION

FIELD OF THE INVENTION

The present invention pertains to a method and system for drilling a wellbore with a drillstem or casing which is left in the wellbore after completion of the drilling using a retrievable motor and bit assembly and a reamer bit portion on the distal end of the casing which is rotatably driven by the retrievable bit assembly.

BACKGROUND

In many well drilling operations, it is desirable to minimize the work required to complete the well by utilizing the so-called casing or well liner as the drillstem which is left in the wellbore upon completion of drilling and a separate liner or casing is not required to be installed upon withdrawal of the drillstem as in conventional drilling operations.

U.S. Pat. Nos. 5,197,553 and 5,271,472, both by Richard E. Leturno and both assigned to the assignee of the present invention, describe one system and method for drilling a well utilizing a drillstem or tubing which is left in the wellbore to function as a casing or wellbore liner. The Leturno patents describe, in one embodiment, a retrievable bit and motor assembly which has extendable and retractable cutters for drilling a wellbore sufficiently large in diameter as to accommodate the drillstem or casing and leave an annular space for circulation of drilling fluid and further wherein the bit and motor assembly may be retrieved from the distal end of the drillstem or casing upon completion of the drilling operation.

However, in drilling certain types of wells, it is desirable to utilize a type of bit sometimes known as PDC (polycrystalline diamond compact) or so-called diamond bits which have a bit head in which certain hard metal or hard mineral inserts are arranged in a predetermined pattern for cutting or crushing the rock as the bit is rotated and advanced into the formation material. This type of bit is often preferred over the so-called roller cone type bits for certain drilling operations. The diamond type bits lend themselves to arrangements wherein a portion of the bit may be permanently mounted to the distal end of the drillstem or casing which is more desirable than configuring the bit to have extendable and retractable arms such as in the arrangement described in the Leturno patents. Moreover, in drilling relatively shallow wells, in particular, the working life or durability of the PDC type bit, including the reamer arrangement, is such as to make attractive the provision of a reamer portion of the bit which is permanently mounted to the distal end of the drillstem. It is to this end that the present invention has been developed to provide an improved method and drilling assembly for drilling wells wherein the drillstem or casing is to be retained in the wellbore upon completion of the drilling operation.

SUMMARY OF THE INVENTION

The present invention provides an improved method and apparatus for drilling a well with a drillstem comprising a "casing" or wellbore liner which may be left in the wellbore after completion of the drilling operation.

In accordance with an important aspect of the present invention, a drillstem comprising a well casing or liner is provided with a bit portion which is rotatable relative to the drillstem and is permanently affixed to the distal end thereof and which is rotatably driven by a downhole drill motor during drilling operations. Upon completion of drilling operations, the drill motor may be retrieved without removal of the drillstem or the distal bit portion.

In accordance with another important aspect of the present invention, an improved reamer bit portion is provided for use with well drilling operations wherein the drillstem comprises the well casing and remains in the wellbore upon completion of the drilling process. The reamer bit portion is advantageously mounted for rotation on the distal end of the drillstem on a sub comprising part of the drillstem and the reamer bit portion includes suitable drive means for engagement by a drive member of a downhole drill motor, which drive member includes a retrievable central bit portion which, together with the reamer bit portion comprises the hole-forming bit.

In accordance with yet a further aspect of the present invention, an improved drilling system is provided comprising a well casing, a casing sub affixed to the distal end of the casing including a reamer bit portion and a retrievable downhole drill motor and bit drivingly engaged therewith which is operable to be inserted in the casing sub and drivingly engaged with the reamer bit portion. The drill motor is operably connected to the casing so that the drill motor body is non-rotatable relative to the casing.

In accordance with still a further important aspect of the present invention, there is provided a unique drill bit assembly comprising a retrievable bit insertable in the reamer bit and engageable therewith by releasable lock means which may be pressure fluid operated by the drilling fluid. The retrievable bit is advantageously arranged to be drivably connected to the output shaft of a downhole fluid operated motor. Upon completion of drilling operations, the motor and central, retrievable bit portion may be removed from the wellbore so that further wellbore operations such as cementing of the drillstring or casing in place may be carried out or further wellbore extending or drilling operations may be conducted.

Those skilled in the art will further appreciate the above-noted advantages and superior features of the present invention, together with other important aspects thereof, upon reading the detailed description which follows in conjunction with the drawing.

DESCRIPTION OF A PREFERRED EMBODIMENT

Figure 1:
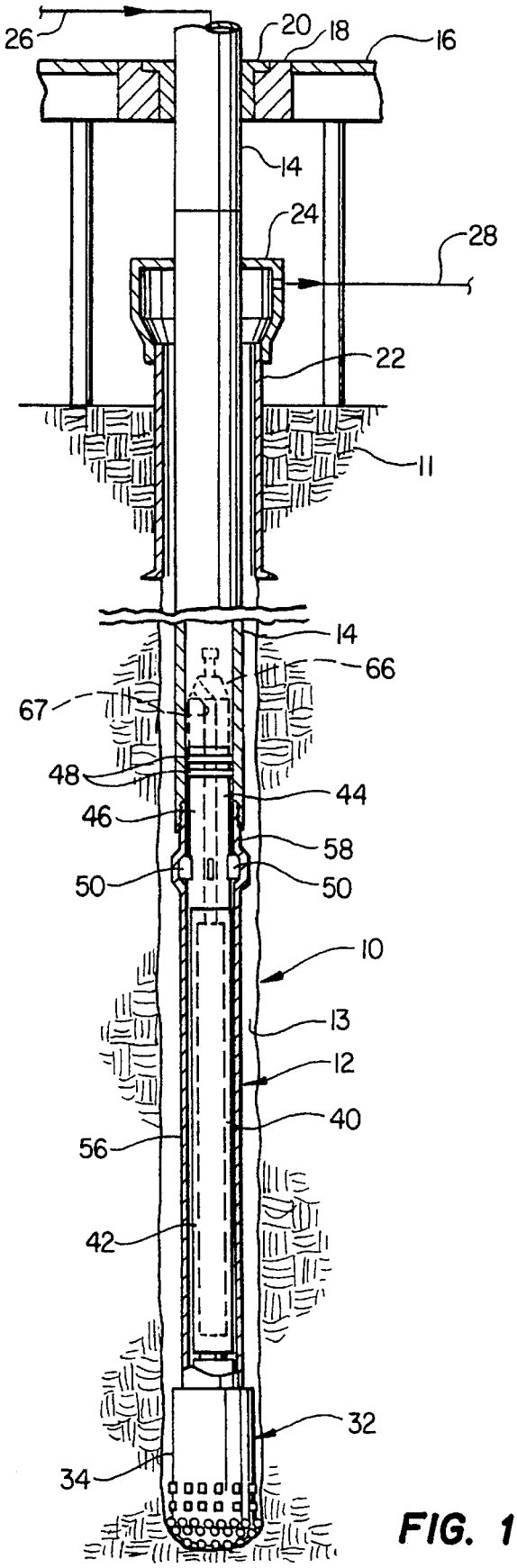
FIG. 1 is a view in somewhat schematic form of a well being drilled with the improved drilling apparatus and method of the present invention.

In the description which follows, like parts are marked throughout the specification and drawing with the same reference numerals, respectively. The drawing figures are not necessarily to scale in the interest of clarity and conciseness. The subject matter of U.S. Pat. Nos. 5,197,553 and 5,271,472 is incorporated herein by reference.

Referring to FIG. 1, there is illustrated a wellbore 10 which is shown being formed by a unique drilling apparatus, generally designated by the numeral 12. The drilling apparatus 12 is shown connected to the distal end of an elongated drillstem 14 which may comprise a relatively large diameter pipe or so-called well casing, particularly of the type used in oil and gas wells to reinforce the wellbore or form a liner therefor. In the illustration of FIG. 1, the drilling operation is being carried out from a conventional drill rig 16 which may include a rotary table 18 having a suitable insert or bushing 20 which may comprise a set of "slips" or drillstem retaining jaws. In the well drilling method and apparatus of the present invention, it is contemplated that the drillstem 14 will not normally be rotated during the drilling operation. Moreover, the drilling operation, although shown being carried out onshore, may also be carried out as an offshore operation. In the illustrative example, the well 10 is drilled into an earth formation 11 and the initial portion of the well 10 is provided with a suitable supporting pipe or casing section 22 and a drill fluid receiving and diverting structure 24 of conventional construction.

During drilling operations, conventional drilling fluid is conducted to the drillstem 14 from a suitable source by way of a conduit 26 and cuttings laden drilling fluid is returned to the surface through the well annulus 13 and the receiver or diverter 24 for flow through a conduit 28 to suitable cuttings separation and fluid conditioning apparatus, not shown. The aforementioned fluid is pumped down through the drillstem 14 under substantial pressure and is ejected at the bottom of the drilling apparatus 12 for flow upward through the wellbore annulus 13 in a conventional manner to provide transport of the drill cuttings from the wellbore. In this regard, the diameter of the wellbore 10 must be such as to provide a suitable annular space for evacuation of the drill cuttings and for eventual placement of a suitably thick layer of cement which will secure the casing 14 in the wellbore to enhance the structural integrity of the well. The nominal clearance between the drillstem 14 and the wellbore wall may be, for example, on the order of 1.50 to 2.0 inches (38 millimeters–51 millimeters).

Figure 2:
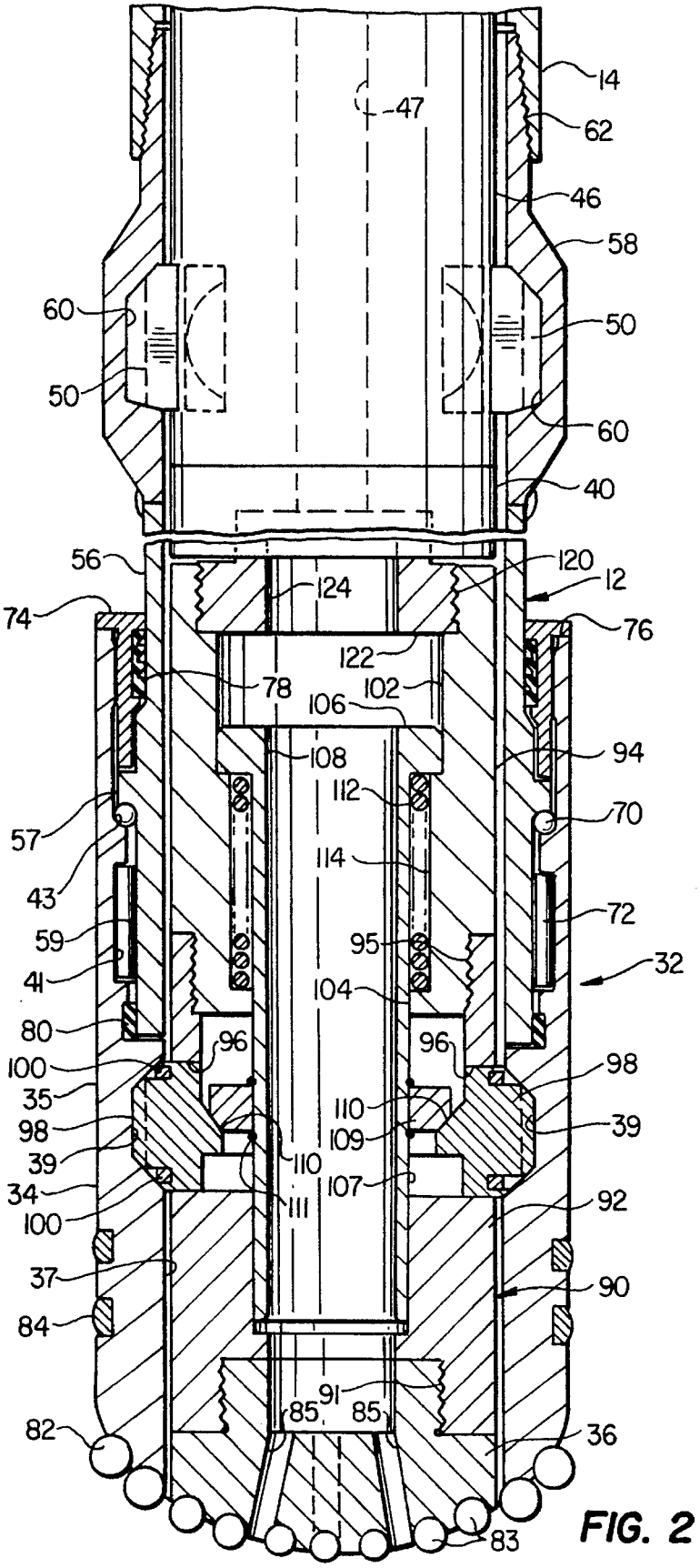
FIG. 2 is a longitudinal central section view of the expendable reamer bit portion and retrievable central bit portion of the drilling apparatus.

In accordance with the invention, the drilling apparatus 12 includes a bit assembly 32 characterized by a generally cylindrical annular reamer bit portion 34, see FIG. 2, and a retractable central bit portion 36. The reamer bit 34 is of sufficient diameter to provide a wellbore diameter, as prescribed above, which is sufficiently larger than the diameter of the drillstem to provide a suitable annular space 13 for fluid flow and for cement placement. The bit assembly 32 is rotatably driven by a downhole fluid operated motor, generally designated by the numeral 40. The motor 40 is suitably disposed in a generally cylindrical body 42 which is attached at its upper end to a latch mechanism 44 also having a generally cylindrical body 46 which supports spaced-apart fluid seals 48 and suitable latch members 50 which are operable to engage the drillstem 14 to prevent rotation of the motor body 42. The motor 40 may be of a type commercially available including a turbine-type motor or a progressive cavity, positive displacement type motor which is operated by pressure fluid conducted down through the drillstem 14 and also comprising the drill cuttings evacuation fluid. A detailed description of the motor 40 is not believed to be necessary to enable those skilled in the art to practice the present invention. One source of a motor of the type which would be suitable for the drilling apparatus 12 is sold under the trademark Posi-Drill by Baker-Hughes Incorporated, Houston, Tex.

Referring further to the drawing figures, the drilling apparatus 12 includes an elongated cylindrical tubular extension member or sub 56 which is adapted to house the drilling motor 40 during drilling operations. The sub 56 includes at its upper end, a sub part 58 which includes suitable cirumferentially spaced receptacles 60, FIG. 2, for receiving the latch members 50. The latch mechanism 44 may comprise conventional mechanism known to those of ordinary skill in the art for extending and retracting the members 50. Moreover, the latch mechanism 44 may function similar to that described in U.S. Pat. Nos. 5,197,553 and 5,271,472. As shown in FIG. 2, the sub part 58 includes suitable threads 62 at its upper end for connecting the drilling apparatus 12 to the lower end of the drillstem 14. Still further, as shown in FIG. 1, the upper end of the latch mechanism 44 may be suitably connected to a fishing head 66, for example, for insertion and retrieval of the motor 40, the latch mechanism 44 and the drill bit portion 36, as will be explained in further detail herein. The insertion and retrievable operation may be carried out in accordance with the method described in the aforementioned patents which are incorporated herein by reference. The latch members 50 may, for example, be spring biased to latch into the receptacles 60 and under a sufficient upward pulling force be operable to retract to allow the latch mechanism 44, motor 40 and bit part 36 to be retrieved from the sub 56 and the drillstem 14.

Referring further to FIG. 2, the sub 56 has formed at its lower end suitable bearing race portions 57 and 59. The reamer bit portion 34 includes a generally cylindrical body 35 having a central bore 37, a plurality of circumferentially spaced latch receptacles 39 and suitable circumferential bearing race portions 41 and 43, for example. The bearing race portions 43 and 57 are engageable with bearing balls 70 to form an angular contact ball bearing assembly, for example, and the race portions 41 and 59 are engageable with suitable rollers 72 to form a roller bearing assembly. The respective bearing assemblies formed by the bearing balls 70 and the rollers 72 are operable to withstand axial and radial bearing loads between the sub 56 and the bit part 34. The bit part 34 is retained on the sub 56 by a suitable split sleeve retainer 74 which is threadedly engaged with the upper end 76 of the bit part. The retainer 74 also supports suitable elastomeric seal means 78 to form a substantially fluid tight seal to prevent incursion of fluids into the bearings 70 and 72. A second elastomeric seal 80 is disposed between the latch receptacles 39 and the bearing race 41, as illustrated.

The bit part 34 includes suitable hard material cutter inserts 82 and so-called gage members 84 arranged in a conventional manner known to those of skill in the polycrystalline diamond compact bit art. Accordingly, the reamer bit part 34 is adapted to rotate relative to the sub 56 and to withstand substantial axial and radial forces exerted thereon commensurate with the forces incurred in drilling earth formations with relatively large diameter and heavy drillstems. Moreover, the simplicity and durability of the bit part 34 is such as to provide for drilling a wellbore of substantial depth without requirement to replace this bit part during drilling operations.

Referring still further to FIG. 2, the drilling apparatus 12 also includes a reamer bit drive mechanism characterized by a generally cylindrical body member 90 having separable body parts 92 and 94 which are threadedly engaged with each other at threads 95. The body part 92 is provided with plural opposed slots 96 for receiving radially movable drive keys or lugs 98 which are operable to be engaged with the reamer bit part 34 in the cooperating receptacles 39. The drive keys 98 are operable to be biased in a retracted position by circular ring spring members 100 not unlike internal combustion engine piston rings. The body part 94 is provided with a suitable stepped bore 102, 104 for receiving a piston 106 having a central bore 108 extending therethrough. The piston 106 is adapted to support a cylindrical cam 109 engaged with cooperating cam follower surfaces 110 on the drive keys 98. The cam 109 is retained on a reduced diameter skirt portion 107 of the piston 106 by suitable retaining rings 111. The piston 106 is biased into an upwardly extended position, not shown, by a suitable coil spring 112 retained in an intermediate bore portion 114 of the body part 94. The bit drive member 90 also includes an internally threaded bore portion 91 at the lower distal end thereof for threaded engagement with the bit part 36 whereby the bit part may be replaced if worn or broken. As with the reamer bit part 34, the bit part 36 includes a suitable arrangement of hard material cutting or crushing elements 83 and plural passages 85 for ejecting drilling fluid into the wellbore to entrain and remove drill cuttings from the wellbore in a conventional manner. As with the reamer bit part 34, the bit part 36 may be constructed substantially in accordance with known types of rotary PDC type bits having hard metal or so-called diamond cutter inserts 83, as described above.

The bit drive member 90 is suitably threadedly connected at threads 120 to an output shaft 122 of the motor 40. An internal passage 124 formed in the shaft 122 is in communication with the bore 102, 104 and the passage 108 for conducting pressure fluid to the passages 85. Pressure fluid entering the bore 102 also acts on the piston 106 to bias the piston against the urging of the spring 112 into the position shown to extend the drive keys 98 into the receptacles 39 so that the drive member 90 is locked for rotation with the reamer bit part 34. In this way, the bit assembly 32 comprising the bit parts 34 and 36 rotate together as one member. In response to a substantial reduction or cessation of flow of pressure fluid through the bore 102, 104 the piston 106 may retract so that the cam 109 allows the drive keys 98 to retract radially inwardly clear of the receptacles 39 whereby the drive member 90, the motor 40 and the latch mechanism 44 may be withdrawn from the drillstem 14 or at least moved upward out of the sub 56. The seals 48 may, upon withdrawal of the latch mechanism 44 upwardly in the drillstem 14, reach a point where the drilling fluid may flow around these seals and down through the drillstem to exit the bore 37.

However, in the positions shown in FIGS. 1 and 2, pressure fluid being conducted down through the drillstem 14 enters a passage 67 in the fishing head 66, if this device is being used, and then flows through a passage 47 in the latch mechanism 44, see FIG. 2, then enters the motor 40 and exits the motor through the passage 124 into the bore 102 to urge the piston 106 to the position shown in FIG. 2. Pressure fluid exiting the motor 40 also flows down through the bore 108 and the passages 85 to exit the drilling apparatus 12 and convey drill cuttings upwardly through the annulus 13. With the drive member 90 in the position shown in FIG. 2, the motor 40 is operable to rotate the bit assembly 32 to affect cutting of the earth formation and creation of the wellbore 10 without rotating the drillstem 14.

Upon completion of the drilling operation and reduction in the pressure of the fluid being conducted down through the drillstem, the motor 40 and the drive member 90, together with the bit part 36, may be removed from the drillstem to provide a substantially full diameter bore within the drillstem 14 including the sub 56. The parts for the bit assembly 32 and the drive member 90 may be constructed of conventional engineering materials used for downhole motors and drilling mechanisms used in oil and gas well operations.

The operation of the drilling apparatus 12 is believed to be understandable to those of ordinary skill in the art from the foregoing description of the apparatus and the features which enable it to be inserted and withdrawn from the drillstem 14 while leaving the drillstem 14 in the wellbore. However, briefly, to commence drilling with the apparatus 12, the sub 56, in assembly with the reamer bit part 34, is set in a pair of suitable slips, not shown, in the rotary table 18. The motor 40 and latch mechanism 44 are then inserted in the sub 56 and the latch mechanism is operated to latch the motor to the sub part 58. The motor 40 and the drive member 90 may then be tested for suitable operation by conducting drilling fluid down through the passage 47, the motor 40 and the drive member 90 to rotate the motor and to lock the drive keys 98 into the receptacles 39. Once the operation of the motor 40 and bit assembly 32 has been tested, the first section of drillstem 14 may be connected to the upper end of the sub part 58 and suitably secured thereto, such as by the cooperating threads 62 and possibly further including welds, not shown, to assure that the drillstem will not become disconnected from the sub 56. A suitable circulating head, not shown, is then attached to the upper end of the drillstem 14, pressure fluid applied through the drillstem and drilling operations commenced by operating the bit assembly 32 to rotate the bit parts 34 and 36 locked together and without rotating the drillstem 14. The drillstem may be lowered by conventional mechanism such as a hoist and tackle, not shown.

The above-mentioned drilling operation is continued and additional joints of drillstem are added as needed until the wellbore is formed to a suitable depth. The last section of drillstem 14 is preferably fitted with a suitable casing hanger or the like to suspend the casing from a wellhead structure, not shown, in a conventional manner.

Upon completion of drilling, a suitable wireline lubricator, such as described and illustrated in U.S. Pat. Nos 5,197,553 or 5,271,472, is rigged up on top of the last joint of the drillstem in a conventional manner and a retrieval tool is then lowered through the drillstem on a suitable line until it engages the fishing head 66, if used, while the pressure of fluid being conducted through the drillstring and to the motor 40 is reduced to allow the piston 106 to retract and drive keys 98 to move out of engagement with the bit part 34. Once the fishing or retrieval tool is connected to the latch mechanism 46, motor 40 and drive member 90, an upward pulling effort may be sufficient to effect retraction of the drive keys 50 out of the receptacles 60 or a suitable retraction mechanism, not shown, may be activated to retract the drive keys 50. In fact, the drive keys 50 may be configured to function in the same manner as the drive keys 98 with suitable piston and cam means, not shown, responsive to pressure fluid to bias the keys 50 into their working positions.

After release of the latch mechanism 44 from the sub 56, the motor 40 and drive member 90 may be retrieved from the drillstem 14 and further operations to secure the drillstem 14 in the wellbore may proceed in a conventional manner.

Although a preferred embodiment of an apparatus and method in accordance with the invention have been described in detail hereinabove, those skilled in the art will recognize that various substitutions and modifications may be made to the invention without departing from the scope and spirit of the appended claims.

What is claimed is:

1. A method for drilling a well with a drillstem which is to be left in the wellbore after drilling has been completed, said method comprising:

connecting a sub onto the lower end of said drillstem, said sub having a reamer bit rotatably mounted on the outer surface thereof whereby said reamer bit remains in the wellbore with said drillstem when said drilling has been completed, said reamer bit having a diameter greater than that of said drillstem;

lowering a fluid-operated, downhole motor having a center bit connected thereto through said drillstem and into said sub wherein said center bit extends out the lower end of said sub and drivingly engages said reamer bit for rotation therewith;

circulating a fluid through said drillstem to operate said motor to thereby rotate both said center bit and said reamer bit to drill a wellbore having a diameter substantially the same as the diameter of said reamer bit without rotating said drillstem; and retrieving said downhole motor and said center bit through said drillstem while leaving said drillstem and said reamer bit in said wellbore.

2. Apparatus for drilling a well from the surface onto an earth formation, said apparatus comprising:

a tubular drillstem extending from the surface and having a central bore therethrouoh open at its lower end;

a cylindrical reamer bit rotatably mounted on the outer surface of the lower distal end of said drillstem and having an open central bore aligned with said central bore of said drillstem, said reamer bit having an outer diameter greater than that of said drillstem whereby the diameter of the wellbore of said well to be drilled with said apparatus shall be greater than that of said drillstem;

a retrievable, fluid-operated downhole motor insertable into and retrievable from said drillstem, said motor having a drive shaft depending therefrom;

a center bit;

means for connecting said center bit to said drive shaft for rotation and retrieval therewith, said center bit having a diameter slightly less than that of said central bore of said drillstem whereby said center bit will extend from said aligned, respective center bores of said drillstem and said reamer bit when said retrievable, downhole motor is in its operable position within said lower end of said drillstem;

releasable means for preventing relative rotational movement between said downhole motor and said drillstem; and releasable means for drivingly connecting said center bit to said reamer bit whereby said reamer bit is rotated upon rotation of said center bit by said downhole motor.

3. The apparatus set forth in claim 2 wherein:

said reamer bit includes bearing race means disposed thereon for engagement with rolling element bearings rotatably supporting said reamer bit on said distal end of said drillstem for transferring axial and radial forces between said reamer bit and said drillstem during rotation of said reamer bit.

4. The apparatus set forth in claim 2 wherein said means for connecting said center bit to said drive shaft comprises:

a drive member having one end connected to said center bit and the other end connected to said drive shaft;

and wherein said releasable means for drivingly connecting said center bit to said reamer bit comprises:

at least one drive key mounted for radial movement within said drive member; and a piston movably mounted in said drive member and responsive to fluid acting thereon to move said at least one drive key into engagement with said reamer bit.

5. The apparatus set forth in claim 4 wherein:

said drive member is drivably connected to a drive shaft of said motor and includes a bore for receiving pressure fluid from said motor.

6. The apparatus set forth in claim 5 wherein:

said center bit includes passage means for ejecting pressure fluid from said drive member to said wellbore for evacuating drilling cuttings from said wellbore.

7. The apparatus set forth in claim 6 wherein said releasable means for preventing relative rotation between said downhole motor and said drillstem comprises:

a latch mechanism including retractable latches carried by said motor for releasably connecting said motor to said drillstem.

8. The apparatus set forth in claim 7 including:

passage means in said latch mechanism for conducting pressure fluid from said drillstem to said motor to effect rotation of said drive member and to provide fluid for evacuating drill cuttings from said wellbore.

* * * * *